US005997655A

United States Patent [19]

Schang

[11] Patent Number: 5,997,655

[45] Date of Patent: Dec. 7, 1999

[54] PANEL WASHING DEVICE

[75] Inventor: Craig Schang, Madison Heights, Mich.

[73] Assignee: BASE Corporation, Southfield, Mich.

[21] Appl. No.: 09/107,758

[22] Filed: Jun. 30, 1998

[51] Int. Cl.[6] ..... A47L 25/00

[52] U.S. Cl. ..... 134/6; 15/218.1; 15/220.4; 15/104.92

[58] Field of Search ..... 15/104.92, 104.93, 15/218, 218.1, 220.4, 221; 134/6

[56] References Cited

U.S. PATENT DOCUMENTS

| | | | |
|---|---|---|---|
| 2,648,858 | 8/1953 | Paull | 15/218.1 |
| 2,654,109 | 10/1953 | Barnes | 15/104.92 |
| 3,913,163 | 10/1975 | Durham . | |
| 5,213,121 | 5/1993 | O'Brien et al. . | |
| 5,471,706 | 12/1995 | Wallock et al. | 15/104.92 |
| 5,652,993 | 8/1997 | Kreyer | 15/104.92 |
| 5,752,286 | 5/1998 | Wright | 15/104.92 |
| 5,794,301 | 8/1998 | Hietala | 15/104.92 |

*Primary Examiner*—Terrence R. Till
*Attorney, Agent, or Firm*—Ryan W. Massey

[57] ABSTRACT

A washing device is provided for cleaning generally flat panels. The washing device includes a base having a slot therein and a pair of sponge-like members disposed along opposing edges of the slot. The base is suspended within a vessel containing washer solvent. The panels are inserted in the slot and scrubbed against the sponge-like members.

5 Claims, 1 Drawing Sheet

PANEL WASHING DEVICE

BACKGROUND OF THE INVENTION

1. Field of the Invention

The present invention relates to a washing device, and more particularly, to a device to aid in washing panels.

BACKGROUND AND SUMMARY OF THE INVENTION

The automotive industry, as well as other industries, are increasingly using plastics for reducing weight, enhancing performance, and for improving the appearance of their products. With the increased use of plastics, new paints have been required in order to provide better performance and a refined appearance to the plastic articles such as vehicle body panels. In the development and testing of these new paint products, the paints are applied to plastic test panels and are tested for various features such as weathering, flexibility, scratch resistance, vulnerability to temperature variations, etc. Prior to applying the paint to the panels, it is necessary to uniformly clean the surface of each panel. Previously, the panels were washed by hand with a sponge or other cleaning implement. The problem with this method is that it took a long time to uniformly clean the entire surface of every panel. Furthermore, the process was an unpredictable and unrepeatable method.

Accordingly, it is desirable to provide a cleaning apparatus and method which allows consistent repeatable scrubbing action on every panel and which takes a fraction of the time for cleaning each panel.

Accordingly, the present invention provides a washing device including a base having a slot therein. A pair of sponge-like members are disposed along opposing edges of the slot. The sponge-like members are wrapped around the opposing edges and securely mounted to the base by upper and lower rigid strip members fastened to the base. The base is suspended within a wash vessel by hanger brackets which hang over the edge of the wash vessel. The panels are pushed through the slot such that the sponges touch both sides of the panel at the same time. The panels are scrubbed against the pair of sponges in order to clean the panel.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
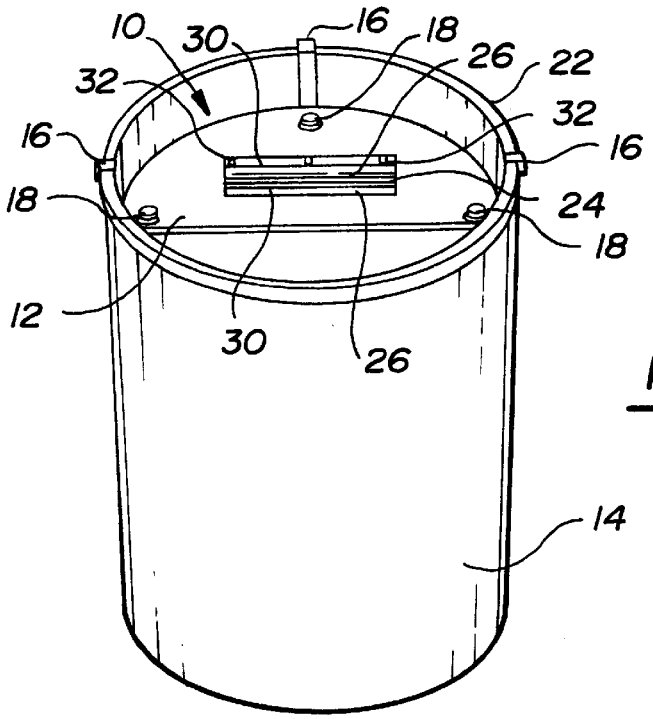
FIG. 1 is a perspective view of the panel washing device as utilized with a vessel containing washer solution, according to the principles of the present invention.
Figure 2:
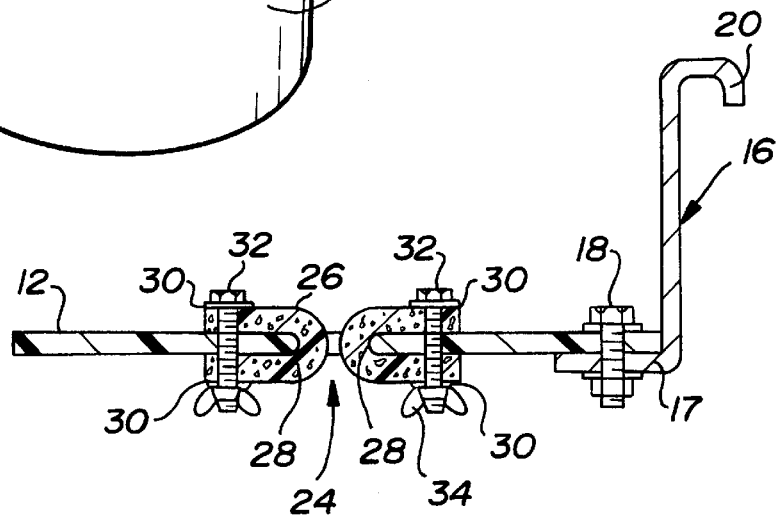
FIG. 2 is a cross-sectional view of the panel washing device according to the principles of the present invention.
Figure 3:
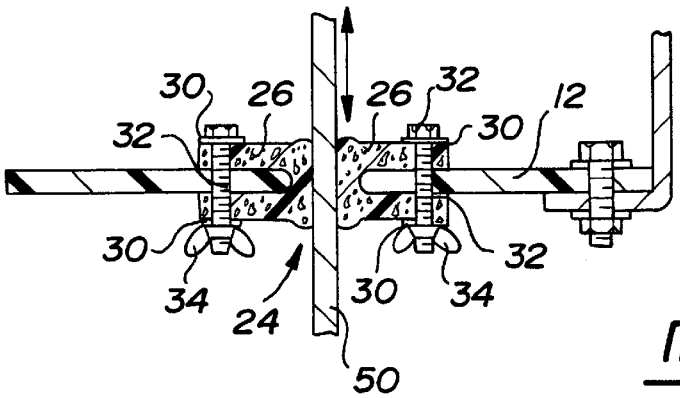
FIG. 3 is a cross-sectional view similar to FIG. 2, with a panel disposed within the slot in contact with the opposing sponge members.

With reference to FIGS. 1–3, the panel washing device according to the present invention will be described. The panel washing device 10 includes a plastic base 12 which is suspended within a vessel 14 by a plurality of aluminum hangers 16. The base 12 is fastened to a band portion 17 of the hangers 16 by a plurality of threaded fasteners 18. Hangers 16 are provided with a hook portion 20 which hangs over an edge 22 of the vessel 14.

The plastic base 12 includes an elongated slot 24. A pair of sponges or sponge-like members 26 are wrapped around opposing edges 28 of slot 24. Sponge-like members 26 are fastened to the plastic base 12 by upper and lower rigid aluminum strip members 30 which are fastened to the base 12 by threaded fasteners 32. The threaded fasteners 32 are provided with wing nuts 34 which allow for easy removal of the sponge-like members 26 without requiring tools.

In operation, the panel washing device 10 is suspended within a vessel 14 such as a five-gallon plastic bucket which contains washing solution up to the level of the sponges 26. The panel 50 is pushed through the slot 24 such that the sponges 26 touch both sides of the panel 50 at the same time. The panel 50 is then scrubbed against the sponges 26 in order to clean the panel 50. The sponges or sponge-like members 26 can be moved closer together or further apart so as to adjust the scrubbing action to be more or less intense on the panels 50. With the panel washing device of the present invention, the washer solution can be reused for several washings. Furthermore, the vessel 14 can be provided with baffles in the bottom thereof which receive debris washed from the panels so that the debris which settles to the bottom of the vessel is not easily stirred up with the remaining washer solution.

The present invention is described as providing a sponge or sponge-like members on opposite sides of the slot 24. However, it should be understood that by "sponge-like members," it is anticipated that sponges or different fabric or brush-type elements can be utilized in place of the sponges in order to provide a similar result. Accordingly, by sponge-like members, it is meant that the substance provides a scrubbing surface which is capable of scrubbing against opposing surfaces of the panel while removing debris therefrom.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A washing device, comprising:

a base having a slot therein;

a pair of sponge-like members disposed along opposing edges of said slot;

means for suspending said base within a wash vessel; and wherein said sponge-like members are wrapped around opposing edges of said slot and securely mounted to said base by upper and lower rigid strip members fastened to said base.

2. The washing device according to claim 1, wherein said means for suspending said base includes a plurality of hanger brackets connected to said base and adapted to hang over an edge of said wash vessel.

3. A washing device, comprising:

a wash vessel;

a base having a slot therein;

a pair of sponge-like members disposed along opposing edges of said slot;

means for suspending said base within said wash vessel; and wherein said sponge-like members are wrapped around opposing edges of said slot and securely mounted to said base by upper and lower rigid strip members fastened to said base.

4. The washing device according to claim 3, wherein said means for suspending said base includes a plurality of hanger brackets connected to said base and having a hook portion for hanging over an edge of said wash vessel.

5. A method of cleaning a plate member, comprising the steps of:

providing washer solvent in a vessel;

suspending a base within said vessel, said base including a slot having a pair of sponges securely wrapped around opposing edges of said slot by means of upper and lower rigid strip members;

inserting said plate member into said slot between said pair of sponges such that said sponges touch both sides of said plate member at the same time; and scrubbing said plate member against said pair of sponges.

* * * * *

UNITED STATES PATENT AND TRADEMARK OFFICE

CERTIFICATE OF CORRECTION

PATENT NO. : 5,997,655
DATED : December 7, 1999
INVENTOR(S) : Craig Schang

It is certified that error appears in the above-identified patent and that said Letters Patent is hereby corrected as shown below:

On the title page, the Assignee should read
[73] Assignee: BASF Corporation, Southfield, Mich.

Signed and Sealed this

Fifteenth Day of August, 2000

*Attest:*

Q. TODD DICKINSON

*Attesting Officer*

*Director of Patents and Trademarks*